US005309858A

United States Patent [19]

Knoos

[11] Patent Number: 5,309,858

[45] Date of Patent: May 10, 1994

[54] STEERING DEVICE FOR SAILBOATS

[76] Inventor: Stellan Knoos, 5933 Avenida Chamnez, La Jolla, Calif. 92037

[21] Appl. No.: 59,078

[22] Filed: May 4, 1993

[30] Foreign Application Priority Data

May 6, 1992 [SE] Sweden ..... 9201426-5

[51] Int. Cl.[5] ..... B63H 25/10

[52] U.S. Cl. ..... 114/144 C

[58] Field of Search ..... 114/144 R, 144 C, 162, 114/164, 167, 168, 39.1

[56] References Cited

U.S. PATENT DOCUMENTS

| | | | |
|---|---|---|---|
| 3,765,361 | 10/1973 | Saye | 114/144 C |
| 3,880,104 | 4/1975 | Saye | 114/144 C |
| 3,983,831 | 10/1976 | Knoos et al. | 114/144 C |
| 4,327,657 | 5/1982 | Knoos | 114/144 C |
| 4,766,833 | 8/1988 | Knöös | 114/144 C |

FOREIGN PATENT DOCUMENTS

| | | | |
|---|---|---|---|
| 2658333 | 6/1978 | Fed. Rep. of Germany | 114/144 C |

*Primary Examiner*—Stephen P. Avila

*Attorney, Agent, or Firm*—Edward A. Sokolski

[57] ABSTRACT

A steering device for sailboats comprises a bracket (11), a rocker (12) pivotally mounted on the bracket and including means for connecting it to a rudder, a servo oar (13) rotatably mounted in the rocker (12), a steering lever (17) mounted on the bracket (11) and pivotable in response to a steering signal, and a linkage (17A/18/23) coupling the steering lever (17) to the servo oar (13) to rotate it in response to the steering signal. The linkage comprises a link rod (18) which extends generally transversely of the axis (L) of rotation of the servo oar (13) and generally forwardly from the servo oar to a lever arm (17A) of the steering lever (17).

2 Claims, 3 Drawing Sheets

STEERING DEVICE FOR SAILBOATS

This invention relates to a steering device for sailboats.

More particularly, the invention relates to a steering device of the class which is disclosed in U.S. Pat. Nos. 3,983,831, 4,327,657 and 4,766,833. Steering devices of this class include a servo oar which is pendulously and rotatably supported by the sailboat such that it is positioned in the water behind the boat. The servo oar is rotatable about its longitudinal axis in response to a steering signal generated by a wind vane, for example, such that the motion of the sailboat, and thus the servo oar, in the water causes the servo oar to deflect sideways and actuate a rudder member to change the course of the sailboat or to counteract a tendency to deviation from a set course.

The present invention provides an improved steering device of the above-mentioned class. More particularly, the improvement is concerned with the mechanism by which a steering signal is converted into a rotational movement of the servo oar.

In accordance with the invention there is provided a steering device for sailboats, comprising a bracket adapted for attachment to a sailboat, a rocker which is pivotally mounted on the bracket for pivotal movement relative to the bracket about a rocker axis which in use of the steering device extends generally in the fore-and-aft direction of the sailboat, the rocker including means for connecting the rocker to a rudder member such that the rudder member is deflected in response to pivotal movement of the rocker about the rocker axis, a servo oar supported by the rocker and pivotally movable together with the rocker about the rocker axis, the servo oar being rotatable relative to the rocker axis about an oar axis which includes an angle with the rocker axis, a steering lever mounted on the bracket for pivotal movement about a steering lever axis including an angle with the rocker axis and the oar axis, the steering lever including a lever arm, steering control means for pivotally moving the steering lever about the steering lever axis, linkage means coupling the lever arm of the steering lever to the servo oar such that the servo oar is rotated about the oar axis in response to pivotal movement of the steering lever about the steering arm axis, the linkage means comprising a link rod extending generally transversely of the oar axis and generally forwardly from the servo oar to the lever arm of the steering lever.

An embodiment of the invention will now be described by way of example with reference to the accompanying drawings.

Figure 1:
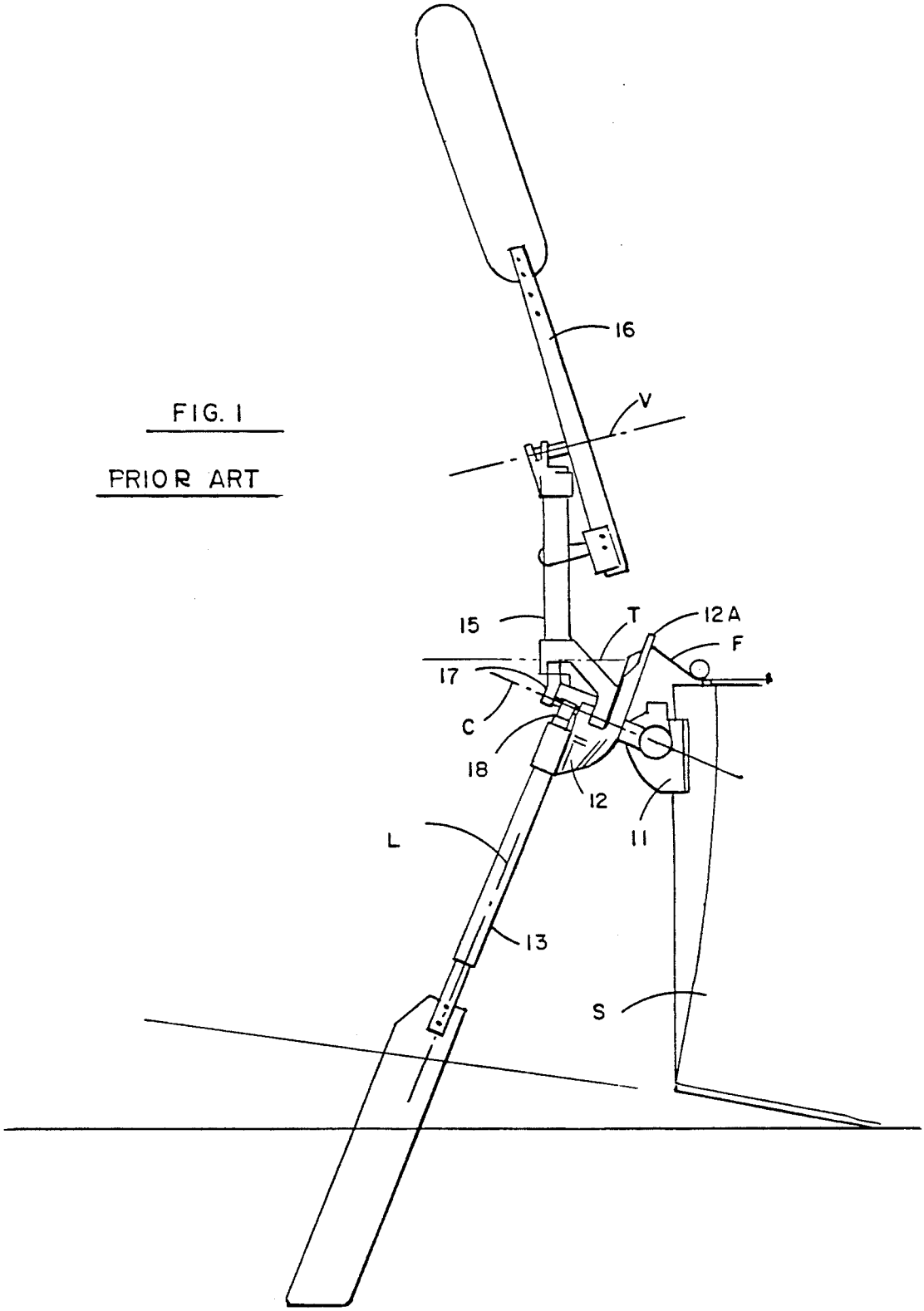
FIG. 1 PRIOR ART
FIG. 1 is a diagrammatic elevational view of a prior art steering device.

The prior art steering device shown in FIG. 1 of the drawings is a commercial embodiment marketed under the designation SAILOMAT® 536 and comprises as main parts: a bracket 11 attached to the transom of a sailboat S; a rocker (pendulum carriage) 12 mounted on an axle (not shown) forming part of the bracket so as to be able to pivot about a rocker axis C positioned substantially in the longitudinal vertical center plane of the sailboat; a servo oar 13 rotatably supported by the bracket 11 so as to be able both to rotate about its longitudinal axis L and to swing sideways about the rocker (pendulum) axis C together with the rocker 12; an upright wind vane support 15 fixedly secured to the axle of the bracket 11, and a wind vane 16 mounted on the top portion of the support 15 for pivotal movement about a wind vane axis V whose orientation in the horizontal plane can be set according to the desired course of the sailboat.

A push rod (concealed in FIG. 1) extending vertically through the wind vane support 15 converts the pivotal movements of the wind vane 16 about the wind vane axis V into pivotal movements of a bell crank steering lever 17 mounted on a base part of the wind vane support for pivotal movements about a stationary steering lever axis T. The steering lever 17 is located rearwardly of the servo oar 13 which can therefore be positioned close to the rear end of the rocker axle.

The pivotal movements of the steering lever 17 are converted into rotational movements of the servo oar 13 about its axis L by means of a link rod 18 which interconnects the steering lever 17 and the servo oar 13. To this end, the link rod 18 is connected to the servo oar 13 for pivotal movements about an axis which is substantially perpendicular to the oar axis C and connected to a lever arm of the steering lever 17 through a ball-and-socket type joint.

Attached to an upward extension 12A of the rocker 12 is a tackle F through which the pendulous movements of the rocker about the rocker axis are transmitted to a rudder member (not shown), such as the main rudder or an auxiliary rudder of the sailboat.

Figure 2:
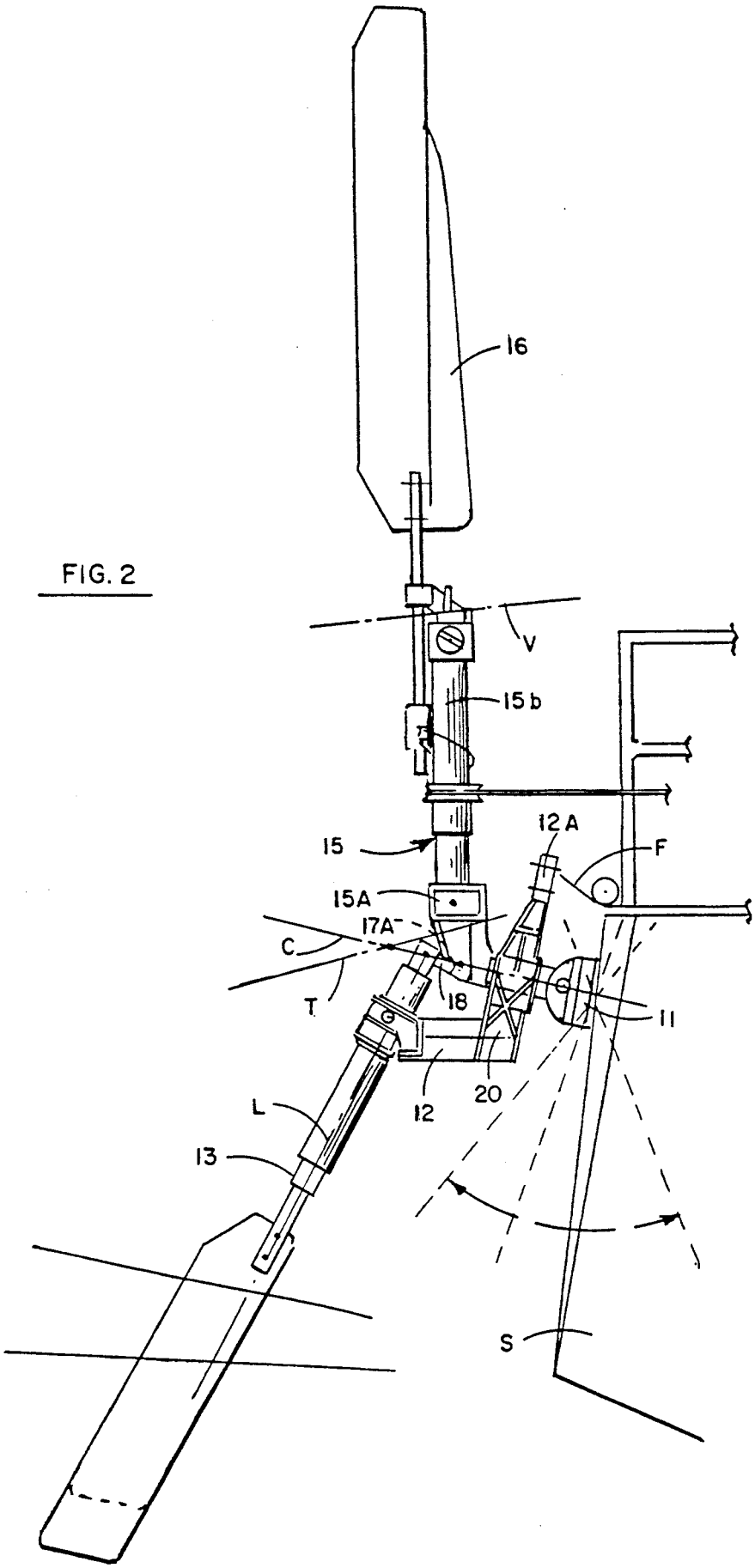
FIG. 2 is an elevational view corresponding to FIG. 1 showing a steering device according to the present invention.
Figure 3:
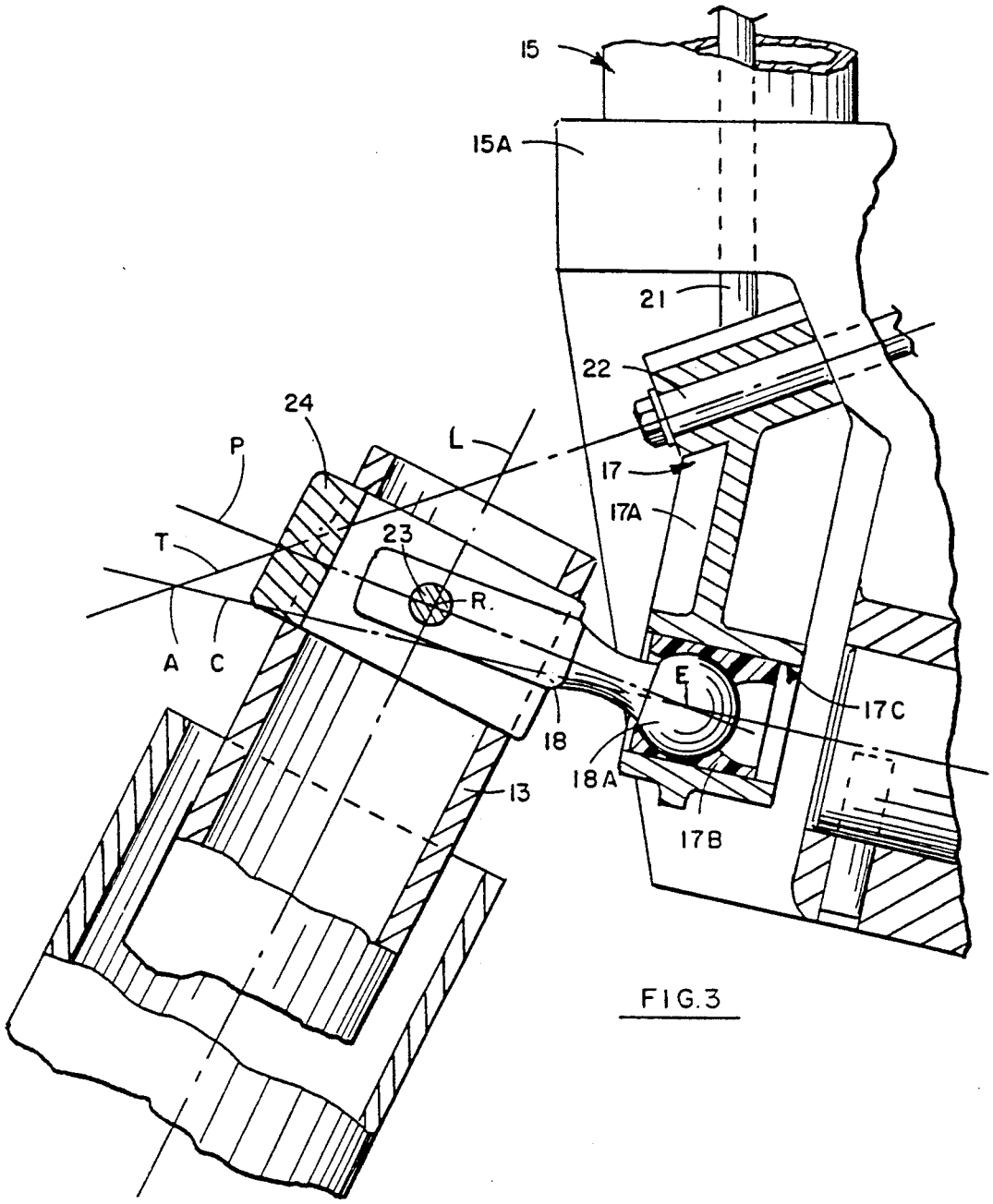
FIG. 3 is an enlarged partial view, partly in section, showing details of the steering device of FIG. 2.

As illustrated in FIGS. 2 and 3, the steering device according to the invention is generally similar to the steering device shown in FIG. 1 and corresponding parts are designated by the same reference numerals and letters. The steering device shown in FIGS. 2 and 3 will be described in detail below only insofar as it differs in essential respects from the steering device shown in FIG. 1.

FIG. 3 shows the axle 20 on which the rocker 12 (not shown in FIG. 3) is mounted. Partially shown in FIG. 3 is also the base part 15A of the wind vane support 15, through the upright tubular part 15B of which the aforementioned push rod 21 extends. The base part 15A is securely fastened to the rearmost part of the axle 20 and may thus be considered as a part of the bracket 11.

The steering lever 17 is a bell crank lever pivotally mounted on a pivot pin 22 secured to the base part 15A. One lever arm of the steering lever (concealed behind the pivot pin 22 in FIG. 3) is connected with the lower end of the push rod 21. The other lever arm 17A extends generally downwardly between the rear end of the rocker axle 20 and the tubular upper end of the servo oar 13. It is connected with the link rod 18 through a ball-and-socket joint formed by the ball-shaped front end portion 18A of the link rod and a socket 17B of low-friction metal or plastic, such as Delrin®. The socket 17B is axially slidable in a bore 17C of the lever arm 17A.

The rear end portion of the link rod 18 is connected through a pivot pin 23 with the upper end of the servo oar 13 such that it is pivotally movable relative to the servo oar about an axis R which is substantially perpendicular to the oar axis L and intersects or is positioned near the oar axis.

Figure 4:
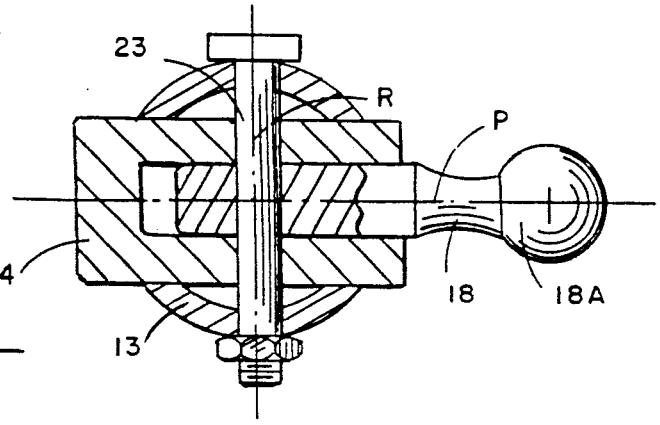
FIG. 4 is a cross-sectional view of certain parts shown in FIG. 3.

FIG. 4 shows a view in cross-section on a plane containing the pivot axis R of the pivot pin 23 and the longitudinal axis P of the link rod 18 and extending perpendicularly or nearly perpendicularly to the servo oar axis L. The rear end of the link rod 18 is positioned between the limbs of a holding fork 24 which is made of a suitable low-friction material, such as bearing bronze, and inserted in a bore extending through the upper end of the tubular shank of the servo oar 13. The link rod 18, the holding fork 24, and the servo oar 13 are held together by the pivot pin 23.

In the position of the steering lever arm 17A shown in FIG. 3, the center E of the ball-shaped link rod portion 18A is shown as being on the rocker axis C but is may also be above or below and/or laterally offset from the rocker axis C. Accordingly, the illustrated position of center E in the neutral position of the steering lever arm 17A and of the servo oar 13 is only an example. What is more important is that in side view as in FIG. 3 the rearward extension of the axis of the bore 17C intersects the rearward extension of the steering lever axis T at a point A behind the axis L of the servo oar 13. Preferably, this point A is situated on or fairly near the rocker axis C.

The exact position of point A is not very critical but its position should preferably be such that the ratio of the distance between point A and the axis R to the distance between axis R and the center point E is in the range of 0.7 to 2.3, the most preferred practical value of this ratio being approximately 1.

The last-mentioned ratio represents a favorable balance of conflicting requirements: On the one hand, point A should be as close as possible to point R, because the closer to point R point A is positioned, the smaller will be not only the tilting movement of the link rod 18 about center E which causes a variation of the angle included between the axis of the bore 17C and the link rod axis, but also the axial sliding movement of the socket 17B in bore 17C. Consequently, the performance-limiting friction between the ball-shaped part 18A and the socket 17B and between the external surface of the socket and the wall of the bore 17C will also be reduced. On the other hand, large angular movements (up to 20°-25°) of the servo oar 13 about axis L are generally desired, and a reduction of the distance between points A and R detracts from the possibility of achieving such large angular movements.

As is shown in FIG. 3 point R is spaced from the rocker axis C by a short distance. This distance also is not very critical, and it is of course within the scope of the invention to position point R on or almost on the rocker axis C. A certain spacing of point R above or below the rocker axis may be desired, however, as such spacing influences the positive or negative "toe-in" of the servo oar in response to the pendulous deflection thereof.

The above-described arrangement of the linkage connecting the steering lever 17 with the servo oar 13, i.e. the positioning of the steering lever arm 17A forwardly of the servo oar 13, provides several advantages over the arrangement of the prior art represented by the device shown in FIG. 1.

For example, the magnitudes of the tilting movements of the link rod about the center E of the ball-and-socket joint 17B/18A and of the axial movements of the socket 17B relative to the steering arm lever 17A are significantly reduced, and the mechanical friction is minimized so that the response of the steering device to wind changes is improved, especially in the case of relatively weak winds, and so that the neck of the link rod 18 i.e. the link rod portion or waist immediately adjacent the ball-shaped portion 18A, need not be heavily reduced in diameter to avoid interference with the steering lever arm 17A or the socket 17B. The reduced friction means reduced wear and longer useful life of the socket 17B and thus of the entire system.

Moreover, larger pendulous deflections of the servo oar can be accommodated without interference between and damage to the components. Actually, the design of the linkage according to the invention permits the servo oar to be swung in one direction almost to an upright position (about 170° from the neutral operating position) so that it can be raised from the water and "parked" out of the water when not in use. Although pendulous deflection in the other direction is more limited (to about 135°), because the wind vane support 15 is offset from the vertical plane containing the rocker axis C, it is still sufficient to meet all practical demands.

I claim:

1. A steering device for sailboats, comprising:

a bracket (11, 15A) adapted for attachment to a sailboat(S), a rocker (12) which is pivotally mounted on the bracket for pivotal movement relative to the bracket about a rocker axis (C) which in use of the steering device extends generally in the fore-and-aft direction of the sailboat, the rocker including means (12A) for connecting the rocker to a rudder member such that the rudder member is deflected in response to pivotal movement of the rocker about the rocker axis, a servo oar (13) supported by the rocker (12) and pivotally movable together with the rocker about the rocker axis (C), the servo oar being rotatable relative to the rocker axis about an oar axis (L) which includes an angle with the rocker axis, a steering lever (17) mounted on the bracket (11) for pivotal movement about a steering lever axis (T) including an angle with the rocker axis (C) and the oar axis (L), the steering lever including a lever arm (17A), steering control means (16) for pivotally moving the steering lever (17) about the steering lever axis (T), and linkage means (17B,18,23) coupling the lever arm (17A) of the steering lever (17) to the servo oar (13) such that the servo oar is rotated about the oar axis (L) in response to pivotal movement of the steering lever about the steering arm axis (T), the linkage means comprising a link rod (18) extending generally transversely of the oar axis and generally forwardly from the servo oar to the lever arm of the steering lever, said link rod (18) being connected with the lever arm (17A) of the steering lever (17) by means of a joint (17B, 18A) having a longitudinal axis which is along the rocker axis (C), said rocker axis (C) intersecting the steering lever axis (T) at a point (A) which is rearward of

2. The steering device of claim 1 wherein said joint (17B, 18A) is a ball and socket joint formed by ball (18A) and socket (17B), said socket being slidably supported for motion along the rocker axis (C).

* * * * *

UNITED STATES PATENT AND TRADEMARK OFFICE

CERTIFICATE OF CORRECTION

PATENT NO. : 5,309,858

DATED : May 10, 1994

INVENTOR(S) : STELLAN KNOOS

It is certified that error appears in the above-indentified patent and that said Letters Patent is hereby corrected as shown below:

Column 4, line 39, claim 1, at the end of the claim after "rearward of" add --the oar axis (L) --.

Signed and Sealed this

Sixth Day of September, 1994

*Attest:*

Bruce Lehman

BRUCE LEHMAN

*Attesting Officer*

*Commissioner of Patents and Trademarks*